US007108358B2

(12) United States Patent
Watanabe et al.

(10) Patent No.: US 7,108,358 B2
(45) Date of Patent: Sep. 19, 2006

(54) PRESSURE BUFFER AND INK-JET RECORDING APPARATUS

(75) Inventors: Toshiaki Watanabe, Chiba (JP); Shigeharu Nishimura, Chiba (JP); Katsuhisa Sakuma, Chiba (JP); Kazuyoshi Tominaga, Chiba (JP); Yuzuki Kubota, Chiba (JP)

(73) Assignee: SII Printek Inc., (JP)

( * ) Notice: Subject to any disclaimer, the term of this patent is extended or adjusted under 35 U.S.C. 154(b) by 276 days.

(21) Appl. No.: 10/867,907

(22) Filed: Jun. 15, 2004

(65) Prior Publication Data

US 2004/0263596 A1 Dec. 30, 2004

(30) Foreign Application Priority Data

Jun. 24, 2003 (JP) ..... 2003-180120

(51) Int. Cl.
*B41J 2/05* (2006.01)

(52) U.S. Cl. ..... 347/67; 347/94; 347/17

(58) Field of Classification Search ..... 347/10, 347/84–87, 92–94

See application file for complete search history.

(56) References Cited

U.S. PATENT DOCUMENTS 4,905,019 A * 2/1990 Vonasek ..... 347/94
6,742,882 B1 * 6/2004 Nakamura ..... 347/92

* cited by examiner

*Primary Examiner*—Juanita D. Stephens
(74) *Attorney, Agent, or Firm*—Adams & Wilks

(57) ABSTRACT

A pressure buffer of an ink-jet recording apparatus is placed in the vicinity of an ink-jet recording head in an ink supply path connecting an ink container to the ink-jet recording head. A body of the pressure buffer has a concave portion at least on one surface, and a flexible film is attached to tightly close the concave portion to form a chamber. The chamber has an ink flow outlet through which ink flows from the chamber to the ink-jet recording head and an ink flow inlet through which ink flows from the ink container to the chamber. The ink flow outlet is always positioned in an uppermost portion in a vertical direction of the chamber, and the ink flow inlet is positioned at an equal level or on a lower side in a vertical direction with respect to the ink flow outlet.

13 Claims, 3 Drawing Sheets

PRESSURE BUFFER AND INK-JET RECORDING APPARATUS

BACKGROUND OF THE INVENTION

1. Field of the Invention

The present invention relates to a pressure buffer for alleviating the fluctuation in pressure of ink supplied to an ink-jet recording head which is applied to a printer, a facsimile machine, and the like, and which performs printing with respect to a recording medium by jetting liquid droplets to the recording medium, and to an ink-jet recording apparatus with the pressure buffer mounted thereon.

2. Description of the Related Art

An ink-jet recording apparatus for recording characters and images on a recording medium by using an ink-jet recording head having a plurality of nozzles for discharging ink has been conventionally known. In such an ink-jet recording apparatus, it is necessary to minimize the fluctuation in pressure of ink supplied to the ink-jet recording head that causes a discharge failure when characters and images are recorded on a recording medium.

FIG. 4 shows a schematic view of an example of an ink-jet recording apparatus 100 provided with a pressure buffer for alleviating the fluctuation in pressure of ink supplied to an ink-jet recording head.

As shown in FIG. 4, in the prior art, the ink-jet recording apparatus 100 includes at least an ink container 101, a force-feed pump 102 for feeding ink from the ink container 101, an ink-jet recording head 103 for receiving the ink fed from the ink container 101 by the force-feed pump 102, and a pressure buffer 105 set on an ink supply path 104 between the force-feed pump 102 and the ink-jet recording head 103.

FIG. 5 shows a plan view of the pressure buffer 105, and FIG. 6 shows a cross-sectional view taken along a line â–â' in FIG. 5 of the pressure buffer 105. The pressure buffer 105 includes a substrate 107 having a concave portion 106 and a connection flow path 108 communicated with the concave portion 106 and connected to the ink supply path 104 at both sides of the substrate 107. Furthermore, a flexible film 109 adheres to the substrate 107 so as to tightly close the concave portion 106 to constitute a chamber 118. Herein, a plurality of support pillars 110 projecting in the concave portion 106 do not adhere to the flexible film 109, and are detachable freely. A packing 112 having a through hole 111 opposed to the chamber 118 is provided outside of the flexible film 109 and an elastic member 113 is provided in the through-hole 111. Furthermore, a pressure plate 114 is provided outside of the packing 112, and a through hole 115 for air vent is provided at a position of the pressure plate 114 opposed to the chamber 118.

In order to fill the ink-jet recording head 103 with ink, the force-feed pump 102 is operated, ink is fed under pressure to the ink-jet recording head 103 in a direction represented by an arrow α shown in FIG. 4, and at this time, all the communicated elements from the ink container 101 to the ink-jet recording head 103 in FIG. 4 are filled with ink so that air bubbles do not remain inside the communicated elements. Furthermore, the ink-jet recording head 103 may be filled with ink by aspirating ink through a nozzle string (not shown) of the ink-jet recording head 103 with a negative pressure.

Furthermore, when the ink-jet recording head 103 is filled with ink that is fed under pressure, the pressure plate 114 suppresses the vibration of the flexible film 109. When the ink-jet recording head 103 is filled with ink that is aspirated with a negative pressure, the support pillars 110 also suppress the vibration of the flexible film 109. Furthermore, the elastic member 113 immediately attenuates the vibration of the flexible film 109.

When the pressure buffer 105 is assembled, the through hole 115 is indispensable for venting air remaining at a position of the flexible film 109 opposed to the chamber 118, and also is used as a window for identifying the ink filling situation of the chamber 118 (e.g., see Patent Document 1).

[Patent Document 1]

Japanese Patent No. 2873435 (pages 1–3, FIGS. 1 and 2)

In the pressure buffer of the prior art, there is the following description: when filling of ink under pressure is performed, the concave portion of the substrate provided in the pressure buffer is filled with the ink so that air bubbles do not remain in the chamber tightly closed with the flexible film.

However, when filling of ink under pressure is actually performed, an air layer is formed by remaining air bubbles compressed in the chamber, and when a compression action by pressure is eliminated after the completion of the filling of ink under pressure, the remaining air bubbles expand to push out the ink filling the chamber from the chamber and diffuse to an ink supply path in the vicinity of the pressure buffer.

When the ink-jet recording head is allowed to discharge ink in this state, the air bubbles diffusing to the ink supply path reach the ink-jet recording head, causing a discharge failure such as dropout.

In order to eliminate the above-mentioned cause, in the pressure buffer of the prior art, before filling of ink under pressure, it is necessary to perform filling of ink by aspiration via a nozzle string of the ink-jet recording head, and after remaining air bubbles in the chamber are removed completely, it is necessary to perform the filling of ink under pressure. Consequently, two filling mechanisms are required, which enlarges the ink-jet recording apparatus and increases a cost.

Furthermore, the pressure buffer of the prior art includes a through hole for air vent placed at a position of the flexible film opposed to the chamber, in the pressure plate outside of the pressure buffer. In the case where filling ink is UV-curable ink, there arises a problem in that light enters the chamber from outside of the pressure buffer to cure the UV-curable ink.

SUMMARY OF THE INVENTION

In view of the above, the present invention proposes a pressure buffer having a structure that is capable of removing air bubbles completely from the chamber only with the filling of ink under pressure, and has an object to suppress the enlargement of the ink-jet recording apparatus and the increase in cost with the pressure buffer.

In addition, the present invention has an object to provide an air vent structure for preventing light from entering the chamber from outside of the pressure buffer in the pressure plate to prevent the UV-curable ink from being cured.

An aspect of the present invention to solve the above-mentioned problems is a pressure buffer of an ink-jet recording apparatus placed in the vicinity of or in an ink-jet recording head in an ink supply path connecting an ink container to the ink-jet recording head, a body of the pressure buffer having a concave portion at least on one surface, and a flexible film being attached so as to tightly close the concave portion to form a chamber, the pressure buffer being characterized in that: the chamber includes at least an ink flow outlet through which ink flows from the chamber to the ink-jet recording head and an ink flow inlet through which ink flows from the ink container to the chamber; during use of the ink-jet recording apparatus, in the case where a flat surface of the chamber corresponding to the flexible film is placed vertically to a horizontal surface, in a plane positional relationship of the chamber, the ink flow outlet is always positioned in an uppermost portion in a vertical direction of the chamber, and the ink flow inlet is positioned at an equal level or on a lower side in a vertical direction with respect to the ink flow outlet. In this case, the ink flow inlet may be positioned in a lowermost portion in the vertical direction in the plane positional relationship of the chamber.

Further, the pressure buffer is characterized in that during the use of the ink-jet recording apparatus, in the case where the flat surface of the chamber corresponding to the flexible film is positioned vertically to the horizontal surface, a shape of the flat surface of the chamber corresponding to the flexible film is included in a region of a rectangle including a line connecting the ink flow outlet to the ink flow inlet as a diagonal and a line extending downward in a vertical direction from the ink flow outlet as one side, and a wall surface of the chamber with respect to the ink flow outlet has a shape at least converging toward the ink flow outlet. In this case, the shape of the flat surface of the chamber may be a parallelogram, a diamond, or an ellipse.

Also, the pressure buffer is characterized in that during the use of the ink-jet recording apparatus, in the case where the flat surface of the chamber corresponding to the flexible film is positioned parallel to the horizontal surface, in a cross-sectional positional relationship of the chamber, at least the ink flow outlet is always positioned in an uppermost portion in a vertical direction of the chamber, and the ink flow inlet is always positioned on a lower side in a vertical direction from the ink flow outlet. In this case, the ink flow inlet may be positioned in a lowermost portion in the vertical direction in the cross-sectional positional relationship of the chamber.

Also, the pressure buffer is characterized in that the pressure buffer includes a rigid reinforcing plate on an outside surface of the flexible film in a state where the reinforcing plate does not adhere to at least a portion of the flexible film corresponding to a surface of the chamber, that the reinforcing plate includes one or a plurality of holes passing through the reinforcing plate for communication with the atmosphere, or a groove structure for communication with the atmosphere which is placed on a surface where the reinforcing plate contacts the flexible film and which does not pass through the reinforcing plate, and that the chamber includes a structure as an elastic member for preventing the flexible film from adhering to a bottom surface of the chamber.

In the pressure buffer according to the present invention, the ink flow outlet is always positioned in an uppermost portion in a vertical direction during use of the ink-jet recording apparatus in plane and cross-sectional positional relationships of the chamber of the pressure buffer. Furthermore, a structure as an elastic member for preventing the flexible film from adhering to a bottom surface of the chamber is provided inside of the chamber, and a rigid reinforcing plate for suppressing excess deformation of the flexible film is provided outside of the chamber.

Thus, even if filling of ink under pressure with respect to the ink-jet recording head from the ink container is performed, air in the chamber is excluded through the ink flow outlet without any trouble, and remaining air bubbles can be removed from the chamber on completion of the filling of ink under pressure without impairing the function of the pressure buffer of the prior art for suppressing excess deformation of the flexible film.

Because of the above, a filling apparatus can be omitted, for filling ink by aspiration with a negative pressure through a nozzle string of an ink-jet recording head, which has been conventionally necessary to be performed prior to the filling of ink under pressure. Consequently, the enlargement of the ink-jet recording apparatus and the increase in cost can be suppressed.

Furthermore, the reinforcing plate includes a groove structure, which is provided on a surface where the reinforcing plate contacts the flexible film and which does not pass through the reinforcing plate as an air vent structure. The body of the pressure buffer and at least the flexible film or the reinforcing plate are respectively made of a material that does not transmit UV-light. This can prevent light from entering the chamber from outside of the pressure buffer, and can prevent the UV-curable ink from being cured.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENT

Hereinafter, the present invention will be described in detail by way of embodiments.

Figure 1:
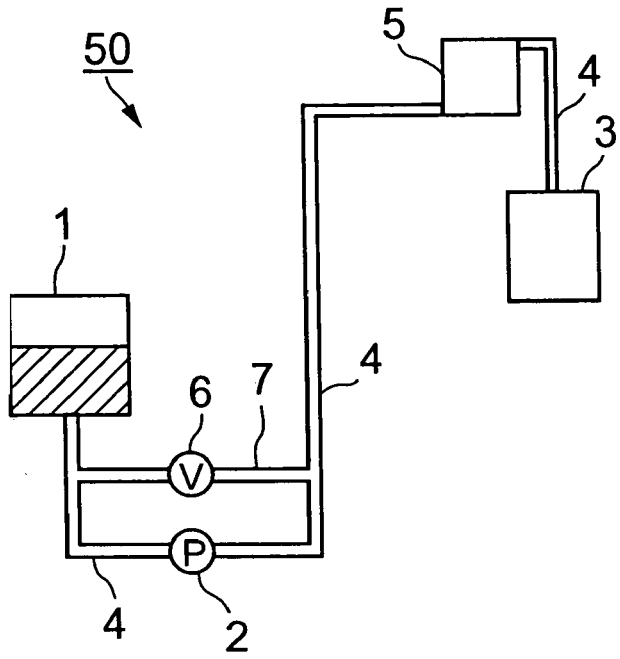
FIG. 1 is a schematic view showing an ink-jet recording apparatus according to an embodiment of the present invention.

FIG. 1 is a schematic view of an ink-jet recording apparatus 50, showing an embodiment of the present invention. The configuration of the ink-jet recording apparatus 50 will be described.

The ink-jet recording apparatus 50 includes at least an ink container 1 for accommodating ink therein, an ink supply path 4 for supplying ink from the ink container 1 to an ink-jet recording head 3 via a pressure buffer 5 alleviating the fluctuation in pressure of the ink supplied to the ink-jet recording head 3, a force-feed pump 2 placed on the ink supply path 4 between the ink container 1 and the pressure buffer 5, an ink supply bypass 7 communicated with the ink supply path 4, which is placed in parallel with a portion of the ink supply path 4 where the force-feed pump 2 is placed and which is capable of supplying ink from the ink container 1 to the ink-jet recording head 3, and an open/close valve 6 provided in the ink supply bypass 7, capable of selectively opening/closing the ink supply bypass 7.

A method of filling the ink-jet recording head 3 with ink using the force-feed pump 2 and the open/close valve 6 is performed in the following procedure. First, the open/close valve 6 is closed to close the ink supply bypass 7. After that, the force-feed pump 2 is operated to feed ink under pressure from the ink container 1 to the ink-jet recording head 3 via the pressure buffer 5. Next, by opening/closing the open/close valve 6 a plurality of times at an appropriate time interval during the operation of the force-feed pump 2, air bubbles are removed from the ink supply bypass 7. After the air bubbles are completely removed therefrom, the force-feed pump 2 is operated for a while, whereby air bubbles are removed completely from the ink supply path 4., the pressure buffer 5, and the ink-jet recording head 3. Finally, after the force-feed pump 2 is stopped, the open/close valve is opened to equilibrate the pressure in the ink supply path leading from the ink container 1 to the ink-jet recording head 3 with the atmospheric pressure.

Herein, the pressure buffer 5 is placed for the purpose of suppressing the fluctuation in pressure of ink supplied to the ink-jet recording head 3, so that it is desirable to place the pressure buffer 5 as close as possible to the ink-jet recording head 3. In particular, in the case of the ink-jet recording apparatus 50 for printing by scanning the ink-jet recording head 3, it is required to mount the pressure buffer 5 and the ink-jet recording head 3 at least on a carriage.

Furthermore, according to the present invention, ink is fed under pressure to the inside of the pressure buffer 5, and therefore it is required that the entire inside of the pressure buffer 5 be filled with ink so as not to break the pressure buffer 5.

Although not shown, there is no problem even if an element for filling the ink-jet recording head 3 with ink by aspiration by generating a negative pressure, via a cap for tightly closing a nozzle string of the ink-jet recording head 3 is introduced. Furthermore, ink spilling from the nozzle string (not shown) after the force-feed pump 2 has been stopped may be wiped off an opening surface of the nozzle string with a wiping member (now shown).

Next, a specific example of the pressure buffer 5 in the ink-jet recording apparatus 50 shown in FIG. 1 will be described with reference to FIG. 2 that is a plan view of the pressure buffer 5, and FIG. 3 that is a cross-sectional view taken along a line E–E' in FIG. 2.

A body 12 has a concave portion 16 at least on one surface thereof, and a flexible film 9 is attached so as to tightly close the concave portion 16 to form a chamber 18. In the case of filling the ink-jet recording head 3 shown in FIG. 1 with ink, the ink-jet recording head 3 is filled with ink via the chamber 18, and therefore the chamber 18 includes an ink flow inlet 10 in which ink flows, and an ink flow outlet 11 from which ink flows.

Herein, in the case of performing the above-mentioned filling by filing under pressure with the force-feed pump 2 in FIG. 1, in order to eliminate an air layer remaining in the chamber 18 to cause a discharge failure, it is required to at least regulate the position of the ink flow outlet 11 in the chamber 18.

Figure 2:
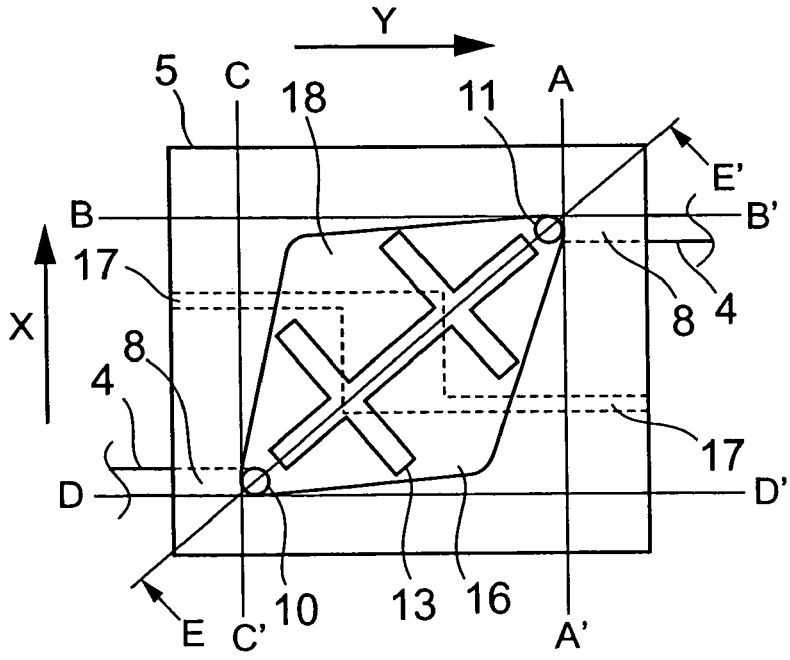
FIG. 2 is a plan view showing an example of a pressure buffer of the present invention.

That is, in the case of placing the pressure buffer 5 so that a flat surface of the chamber 18 corresponding to a flexible film 9 is placed vertically to a horizontal surface, specifically, in the case where an arrow X in FIG. 2 represents an upward direction in a vertical direction, in a plane positional relationship of the chamber 18, it is required that the ink flow outlet 11 be placed so as to be always positioned in an uppermost portion in a vertical direction of the chamber 18, and the ink flow inlet 10 be placed so as to be positioned at the same level or on the lower side in a vertical direction with respect to the ink flow outlet 11. With this arrangement, during the filling under pressure, the chamber 18 is filled with ink from a lower portion of the chamber 18, and an air layer formed in an upper portion of the chamber 18 is discharged from the ink flow outlet 11 positioned in the uppermost portion in the vertical direction of the chamber 18. Therefore, it is possible to fill the chamber 18 completely with ink.

Furthermore, during the filling under pressure, the chamber 18 is filled with ink from the lower portion of the chamber 18. Therefore, in the case where the arrow X in FIG. 2 represents an upward direction in a vertical direction, in the plane positional relationship of the chamber 18, the ink flow inlet 10 is desirably placed so as to be positioned in a lowermost portion in the vertical direction of the chamber 18.

Furthermore, even in the case where an arrow Y in FIG. 2 represents the upward direction in the vertical direction, if it is possible, in the plane positional relationship of the chamber 18, to provide the ink flow outlet 11 so as to be always positioned in the uppermost portion in the vertical direction of the chamber 18, and to provide the ink flow inlet 10 so as to be positioned on a lower side in a vertical direction from the ink flow outlet 11, desirably in a lowermost portion in the vertical direction, the degree of freedom of a setting embodiment of the pressure buffer 5 increases, which contributes to the miniaturization of the ink-jet recording apparatus 50 in FIG. 1.

In the case where the pressure buffer 5 is provided so that a flat surface of the chamber 18 corresponding to the flexible film 9 is placed vertically to a horizontal surface, specifically, in the case where the arrow X in FIG. 2 represents the upward direction in the vertical direction, a shape of the flat surface of the chamber 18 in this case must be included in a region of a rectangle including a line connecting the ink flow outlet 11 to the ink flow inlet 10 as a diagonal and a line extending downward in a vertical direction from the ink flow outlet 11 as one side, specifically, in a region of a rectangle formed by a line A–A', a line B–B', a line C–C', and a line D–D' in FIG. 2. Furthermore, in order to achieve the discharge of the air layer without any trouble, it is required that a wall surface of the chamber 18 with respect to the ink flow outlet 11 have a shape at least converging toward the ink flow outlet 11 as shown in FIG. 2.

Thus, it is desirable that the shape of the flat surface of the chamber 18 be a parallelogram, above all, a diamond or an ellipse.

Furthermore, the setting embodiment of the pressure buffer 5 corresponds to a serial ink-jet recording apparatus in which the ink-jet recording head in FIG. 1 is mounted on a carriage, and which performs printing or drawing on a medium by the scanning of the carriage. For the purpose of alleviating the fluctuation in pressure due to an inertial force of ink generated during scanning of the carriage, the surface of the flexible film 9 is only set to be orthogonal to the scanning direction, specifically, at least the arrow X or the arrow Y in FIG. 2 is in the upward direction in the vertical direction.

However, the action of alleviating the fluctuation in pressure of ink supplied to the ink-jet recording head 3 by the pressure buffer 5 is very effective because the action alleviates the influence due to an external shock even with respect to the ink-jet recording apparatus 50 of an embodiment in which the carriage is not scanned. In this case, the setting embodiment of the pressure buffer 5 is not necessary to be set in such a manner that the surface of the flexible film 9 is orthogonal to the scanning direction. Thus, even if the pressure buffer 5 is provided so that the flat surface of the chamber 18 corresponding to the flexible film 9 is parallel with the horizontal surface, there is no problem. Specifically, this refers to the case where an arrow Z in FIG. 3 is an upward direction in a vertical direction.

Even in this case, in order to achieve the discharge of an air layer formed in an upper portion of the chamber 18 without trouble, in a cross-sectional positional relationship of the chamber, it is required that the ink flow outlet 11 be provided so as to be always positioned in the uppermost portion in the vertical direction of the chamber 18, and the ink flow inlet 10 be provided on the lower side in the vertical direction from the ink flow outlet 11, desirably in the lowermost portion in the vertical direction.

Furthermore, during the filling under pressure, the inside of the chamber 18 is pressed, and the flexible film 9 is subject to a force in a direction opposite to a fixing surface with respect to the body 12, i.e., a force displacing outside. In the case where the force due to the filling under pressure is of such magnitude that the flexible film 9 is peeled from the body 12 or the flexible film 9 is broken, in order to prevent the peeling or breakage, it is required to provide a rigid reinforcing plate 14 outside of the flexible film 9 as shown in FIG. 3. When the reinforcing plate 14 is provided so that the plate adheres to the flexible film 9 completely, the action of alleviating a pressure due to the displacement of the flexible film 9 is lost. Therefore, it is required that the pressure buffer 5 have the reinforcing plate 14 under a condition that the reinforcing plate 14 does not adhere to at least a portion of the flexible film 9 corresponding to the surface of the chamber Furthermore, the pressure buffer 5 having the reinforcing plate 14 creates the action of alleviating a pressure by allowing the flexible film 9 to be displaced corresponding to the fluctuation in pressure of ink in the chamber 18. When air is sealed in a gap between the reinforcing plate 14 and the flexible film 9, the action of alleviating a pressure becomes gentle. Therefore, it is required that the gap between the reinforcing plate 14 and the flexible film 9 have a structure for always being communicated with the atmosphere, e.g., one or a plurality of holes passing through the reinforcing plate 14.

Figure 3:
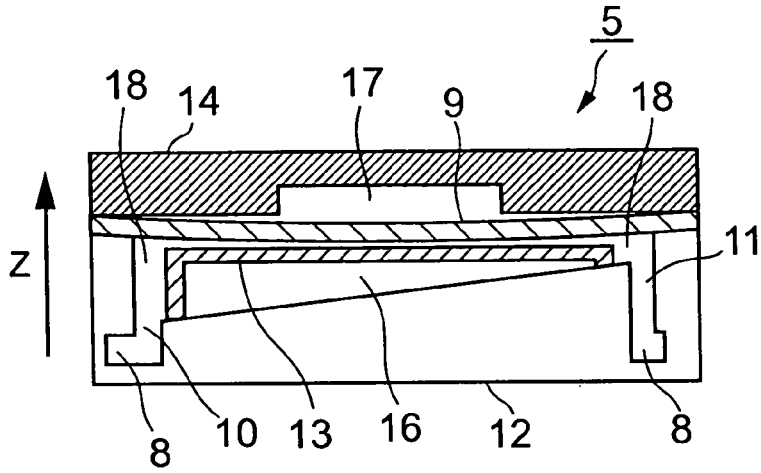
FIG. 3 is a cross-sectional view showing an example of the pressure buffer of the present invention.
Figure 4:
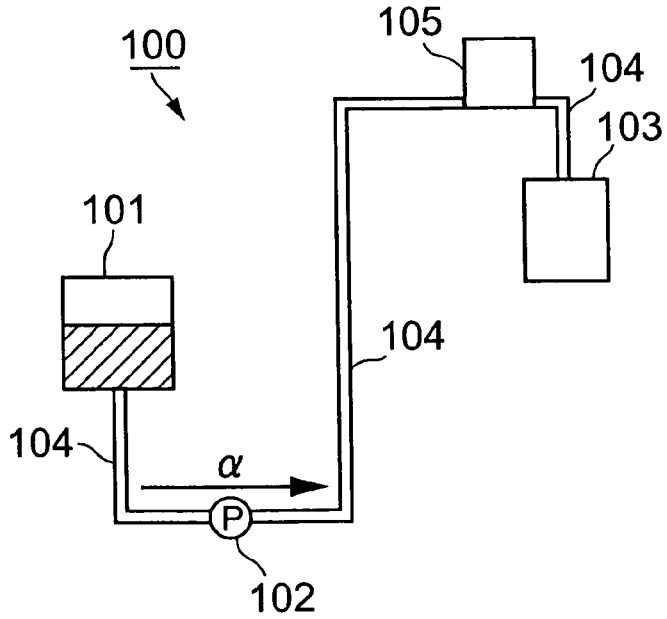
FIG. 4 PRIOR ART
FIG. 4 is a schematic view showing an ink-jet recording apparatus of the prior art.
Figure 5:
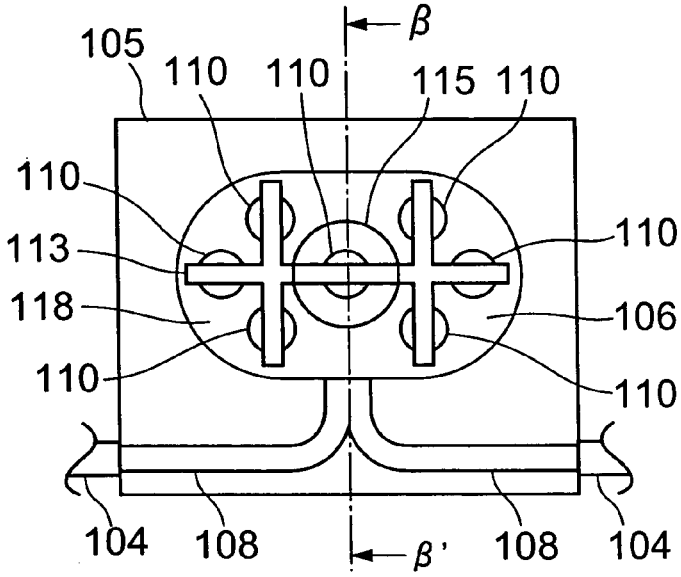
FIG. 5 PRIOR ART
FIG. 5 is a plan view showing the pressure buffer of the prior art.
Figure 6:
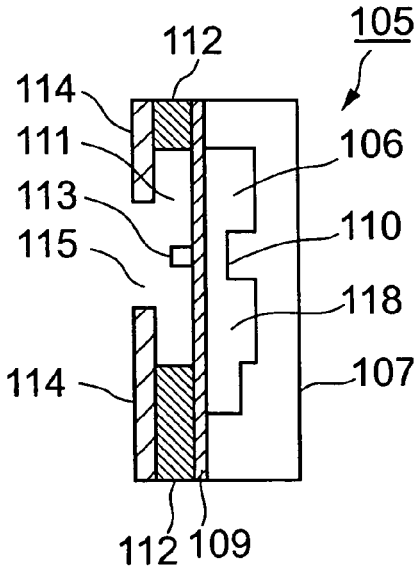
FIG. 6 PRIOR ART
FIG. 6 is a cross-sectional view showing the pressure buffer of the prior art.

Furthermore, when UV-curable ink is used, to prevent light from entering the chamber 18 from an outside portion of the pressure buffer 5 and to prevent the ink from being cured, the reinforcing plate 14 has a groove structure which is provided on a surface of the reinforcing plate 14 contacting the flexible film 9 and which does not pass through the reinforcing plate 14, specifically, an atmosphere communication groove 17 as shown in FIGS. 2 and 3. When the flexible film 9 is displaced outside during the filling under pressure, it is required that the flexible film 9 be not damaged to be broken by an edge of the atmosphere communication groove 17.

Furthermore, in order to prevent the flexible film 9 from adhering to a bottom surface of the chamber 18, i.e., a bottom surface corresponding to a slope portion of the concave portion 16 of the body 12 in FIG. 3 to inhibit the flow of ink in the chamber 18 when the flexible film 9is displaced corresponding to the fluctuation in pressure of ink in the chamber 18, it is required to provide a structure for preventing the flexible film 9 from adhering to the bottom surface of the chamber 18 inside the chamber 18. In particular, in order to make the displacement of the flexible film 9 smooth and to bring about a satisfactory influence on the action of alleviating a pressure, the structure for preventing the flexible film 9 from adhering to the bottom surface of the chamber 18 is desirably an elastic member 13 corresponding to a plate spring as shown in FIGS. 2 and 3. Herein, the elastic member 13 in FIG. 3 is not provided in parallel with the bottom surface corresponding to the slope portion of the concave portion 16 of the body 12. However, the setting embodiment of the elastic member 13 in the chamber 18 is not limited thereto, and needless to say, the setting embodiment only needs to be designed so that the flexible film 9 does not adhere to the bottom surface.

Furthermore, when UV-curable ink is used, in order to prevent the ink from being cured, needless to say, it is necessary that the body 12 and the flexible film 9 be respectively made of a material that does not transmit UV-light in the case where the pressure buffer 5 does not have the reinforcing plate 14, and at least the body 12 and the reinforcing plate 14 be respectively made of a material that does not transmit UV-light in the case where the pressure buffer 5 has the reinforcing plate 14.

As is described above, according to the present invention, the ink flow outlet in the pressure buffer is always positioned in the uppermost portion in the vertical direction during use of the ink-jet recording apparatus in the plane and cross-sectional positional relationships of the chamber of the pressure buffer. Furthermore, the elastic member for preventing the flexible film of the pressure buffer from adhering to the bottom surface of the chamber is provided inside of the chamber, and the rigid reinforcing plate for suppressing excess deformation of the flexible film is provided outside of the chamber.

Thus, even if filling of ink under pressure with respect to the ink-jet recording head from the ink container is performed, air in the chamber is excluded through the ink flow outlet without any trouble, and remaining air bubbles can be removed from the chamber on completion of the filling of ink under pressure without impairing the function of the pressure buffer of the prior art for suppressing excess deformation of the flexible film.

Because of the above, a filling apparatus can be omitted, for filling ink by aspiration with a negative pressure through the nozzle string of the ink-jet recording head, which is conventionally necessary to be performed prior to the filling of ink under pressure. Consequently, the enlargement of the ink-jet recording apparatus and the increase in cost can be suppressed.

Furthermore, the reinforcing plate includes the groove structure which is provided on the surface where the reinforcing plate contacts the flexible film and which does not pass through the reinforcing plate as an atmosphere communication structure. The body of the pressure buffer, and at least the flexible film or the reinforcing plate are respectively made of a material that does not transmit UV-light. This can prevent light from entering the chamber from outside of the pressure buffer, and can prevent the UV-curable ink from being cured.

What is claimed is:

1. A pressure buffer of an ink-jet recording apparatus, the pressure buffer being placed in a vicinity of or in an ink-jet recording head in an ink supply path connecting an ink container to the ink-jet recording head to alleviate a fluctuation in pressure of ink supplied from the ink container to the ink-jet recording head, the pressure buffer comprising:

a body having a concave portion, a flexible film that is attached to the body to tightly close the concave portion, thereby forming a chamber;

an ink flow inlet in which ink flows from the ink container to the chamber; and an ink flow outlet through which ink flows from the chamber to the ink-jet recording head, wherein, during use of the ink-jet recording apparatus, in a case where a surface of the flexible film is placed vertically to a horizontal surface, the ink flow outlet is always positioned in an uppermost portion in a vertical direction of the chamber, and the ink flow inlet is formed to be positioned at a same height or on a lower side in a vertical direction with respect to the ink flow outlet.

2. A pressure buffer according to claim 1, wherein, during the use of the ink-jet recording apparatus, in the case where the flat surface of the chamber corresponding to the flexible film is placed vertically to the horizontal surface, the ink flow inlet is positioned in a lowermost portion in the vertical direction in the plane positional relationship of the chamber.

3. A pressure buffer according to claim 1, wherein, during the use of the ink-jet recording apparatus, in the case where the flat surface of the chamber corresponding to the flexible film is positioned vertically to the horizontal surface, a shape the flat surface of the chamber corresponding to the flexible film is included in a region of a rectangle including a line connecting the ink flow outlet to the ink flow inlet as a diagonal and a line extending downward in a vertical direction from the ink flow outlet as one side, and a wall surface of the chamber with respect to the ink flow outlet has a shape at least converging toward the ink flow outlet.

4. A pressure buffer according to claim 3, wherein the shape of the flat surface of the chamber is a parallelogram, a diamond, or an ellipse.

5. A pressure buffer according claim 1, wherein, during the use of the ink-jet recording apparatus, in a case where the flat surface of the chamber corresponding to the flexible film is positioned parallel to the horizontal surface, in a cross-sectional positional relationship of the chamber, at least the ink flow outlet is always positioned in an uppermost portion in the vertical direction of the chamber, and the ink flow inlet is always positioned on a lower side in a vertical direction from the ink flow outlet.

6. A pressure buffer according to claim 5, wherein, during the use of the ink-jet recording apparatus, in the case where the flat surface of the chamber corresponding to the flexible film is positioned parallel to the horizontal surface, the ink flow inlet is positioned in a lowermost portion in the vertical direction in the cross-sectional positional relationship of the chamber.

7. A pressure buffer according to claim 1, further comprising a rigid reinforcing plate on an outside surface of the flexible film in a state where the reinforcing plate does not adhere to at least a portion of the flexible film corresponding to a surface of the chamber.

8. A pressure buffer according to claim 7, wherein the reinforcing plate comprises one or a plurality of holes passing through the reinforcing plate, as a structure for always communicating a gap between the reinforcing plate and the flexible film with the atmosphere.

9. A pressure buffer according to claim 7, wherein the reinforcing plate comprises a groove structure which is placed on a surface where the reinforcing plate contacts the flexible film and which does not pass through the reinforcing plate, as a structure for always communicating the gap between the reinforcing plate and the flexible film with the atmosphere.

10. A pressure buffer according to claim 1, further comprising, in the chamber, a structure for preventing the flexible film from adhering to a bottom surface of the chamber.

11. A pressure buffer according to claim 10, wherein the structure for preventing the flexible film from adhering to the bottom surface of the chamber is an elastic member.

12. A pressure buffer according to claim 1, wherein the body of the pressure buffer, and at least the flexible film or the reinforcing plate are each made of a material that does not transmit UV-light.

13. An ink-jet recording apparatus comprising the pressure buffer according to claim 1.

* * * * *